United States Patent [19]

Fuller

[11] 4,240,251

[45] Dec. 23, 1980

[54] CAVITATION COMPENSATING PROPELLER NOZZLE OR DUCT

[76] Inventor: Ronald G. Fuller, P.O. Box 1522, Kingston, Ontario K7L 5C7, Canada

[21] Appl. No.: 909,529

[22] Filed: May 25, 1978

Related U.S. Application Data

[63] Continuation of Ser. No. 731,506, Oct. 12, 1976, abandoned, which is a continuation-in-part of Ser. No. 493,753, Aug. 1, 1974, Pat. No. 3,999,884.

[51] Int. Cl.[3] ..... B63H 11/00; B63H 1/18

[52] U.S. Cl. ..... 60/221; 415/116; 115/71

[58] Field of Search ..... 60/221, 269; 114/151, 114/166; 115/11, 12 R, 12 A, 14, 16, 42; 415/52, 53, 55, 56, 58, 108, 116, 117, 119, 144, DIG. 1

[56] References Cited

U.S. PATENT DOCUMENTS

| | | | |
|---|---|---|---|
| 442,615 | 12/1890 | Dock | 415/144 |
| 2,692,572 | 10/1954 | Sparling | 60/221 |
| 3,499,412 | 3/1970 | Anthes et al. | 115/42 |
| 3,508,517 | 4/1970 | Hannan | 415/DIG. 1 |
| 3,677,660 | 7/1972 | Taniguchi et al. | 60/221 |
| 3,899,992 | 8/1975 | Fuller | 115/42 |
| 4,003,671 | 1/1977 | Huse et al. | 415/116 |

FOREIGN PATENT DOCUMENTS

| | | | |
|---|---|---|---|
| 469762 | 12/1928 | Fed. Rep. of Germany | 115/42 |
| 1310135 | 10/1962 | France | 115/42 |

*Primary Examiner*—John J. Vrablik
*Attorney, Agent, or Firm*—Edward J. Brenner

[57] ABSTRACT

A propeller nozzle or duct having means for admitting fluid under pressure into the area of cavitation for the purpose of inhibiting bubble formation and implosion to suppress cavitation and reduce cavitation erosion, the means comprising walls forming an annular passage within the nozzle or duct, a passage communicating between the annular passage and the space within the nozzle or duct below the horizontal centerline thereof, and a passage communicating between the annular passage means and an area above the horizontal centerline coincidental with the zone of potential cavitation within the nozzle or duct and positioned substantially in the plane of the propeller such that fluid subjected to an augmented pressure under the influence of the propeller blade below the horizontal center line will be at an incremental pressure above that of the fluid above the horizontal center line to thereby promote the flow of fluid from the former location to the latter location through the passage there communicating to the area of cavitation. In an alternative embodiment fluid within the annular passage is subject to further pressurization from energy means external to the nozzle and propeller.

3 Claims, 5 Drawing Figures

CAVITATION COMPENSATING PROPELLER NOZZLE OR DUCT

CROSS REFERENCE TO RELATED APPLICATIONS

The present application is a continuation of copending Ser. No. 731,506, filed Oct. 12, 1976, now abandoned which in turn is a continuation-in-part of Ser. No. 493,753, filed Aug. 1, 1974, now U.S. Pat. No. 3,999,884, of the present applicant.

BACKGROUND OF THE INVENTION

The present invention is an improvement of the system disclosed in my earlier application Ser. No. 493,753, entitled "Compensated Propeller Nozzles or Ducts" and results from a new cavitation erosion test method recently introduced by the Ship Research Institute of Norway, use of which method more precisely determines the location of the eroded area due to cavitation as being about fifty degrees from the vertical centerline.

SUMMARY OF THE INVENTION

The present invention provides for water, or other fluid, to be injected into the area newly defined as delineated by the area of erosion on the inner side of the nozzle, for the purpose of inhibiting cavitation and erosion. More particularly, the present invention is directed to means comprising walls forming an annular passage within the nozzle or duct, a passage communicating between the annular passage and the space within the nozzle or duct below the horizontal centerline thereof, and a passage communicating between the annular passage means and an area above the horizontal centerline coincidental with the zone of potential cavitation within the nozzle or duct and positioned substantially in the plane of the propeller such that fluid subject to an augmented pressure under the influence of the propeller blade below the horizontal center line will be at an incremental pressure above that of the fluid above the horizontal center line to thereby promote the flow of fluid from the former location to the latter location through the passage there communicating to the area of cavitation. In an alternative embodiment fluid within the annular passage is subject to further pressurization from energy means external to the nozzle and propeller.

BRIEF DESCRIPTION OF THE DRAWINGS

The accompanying drawings illustrate two embodiments of the present invention by means of vertical sections in FIG. 1 and FIG. 2.

DESCRIPTION OF THE PREFERRED EMBODIMENTS

Figure 1:
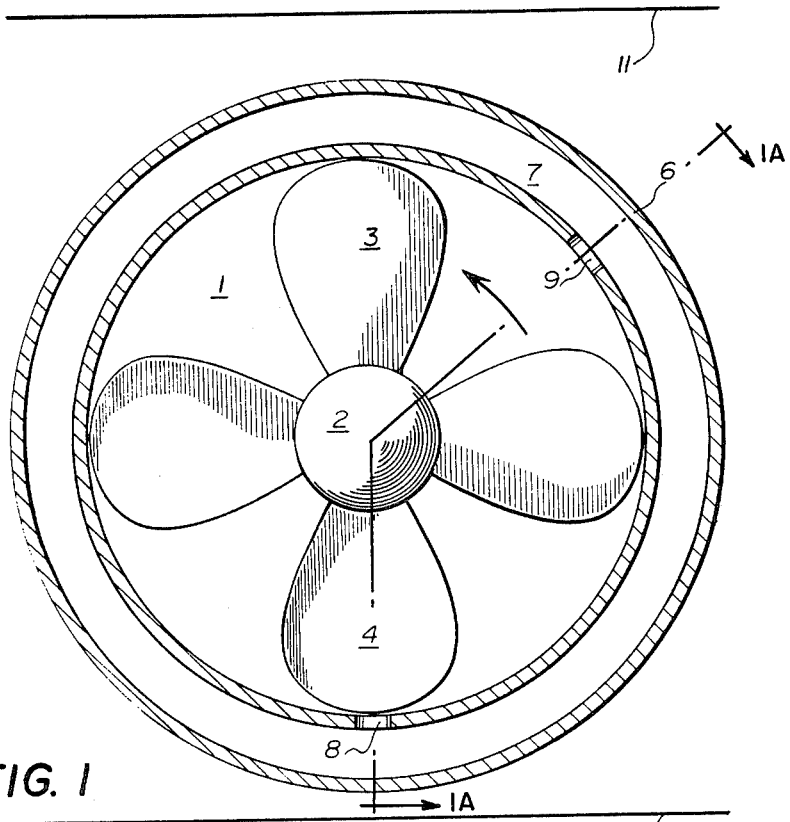
FIGS. 1A and 2A are side views of the two embodiments of the present invention shown in FIGS. 1 and 2.

In the Figures, 1 is a duct or nozzle, 2 is a screw propeller, 3 and 4 are propeller blades, 5 is the inner wall of the nozzle, 6 is the outer wall of the nozzle, 7 is the annular void defined within walls 5 and 6, 8 is a passageway penetrating the inner wall 5 at a point of high differential pressure adjacent to blade 4 and communicating with void 7. 9 is a passageway penetrating the inner wall 5 and communicating with void 7 at a position determined in the upper half of the nozzle cirumference to coincide with the area of cavitation which is about fifty degrees from the vertical centerline. 11 represents the surface of the liquid in which the nozzle and propeller combination is immersed, and 10 is a passage for connecting an external source for the injection of fluid into the void 7 and hence through the passage 9 adjacent to an area of cavitation for the purpose of suppressing same.

Refernece numeral 12 designates a ship incorporating a nozzle or duct 1 in accordance with the present invention.

From the figures, it will be seen that the propeller will be subjected to a hydrostatic pressure which will vary across the propeller blades in proportion to their depth of submergence. Cavitation is related to the net position suction head which in turn is a function of the depth of submergence. The net positive suction head can be optimized and the onset of cavitation suppressed by utilizing the pressure differential generated across the blades of a propeller in an axial direction when transmitting power to the fluid of immersion.

Referring to FIG. 1, it will be seen that fluid subjected to an augmented pressure under the influence of propeller blade 4 will be at an incremental pressure above that generated adjacent to blade 3 due to the hydrostatic pressure differential arising from the depth of submergence and which will tend to promote the circulation of fluid through passageway 8 to 9 through said annular void 7 and passageway to thereby counter cavitation in the area adjacent to passage 9.

Figure 2:
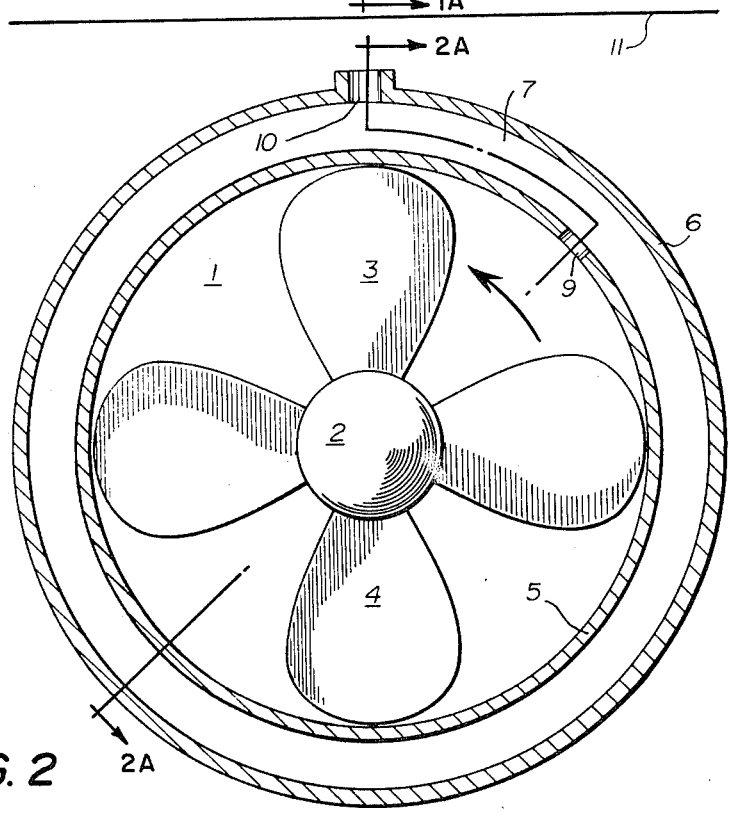
Figure 1A:
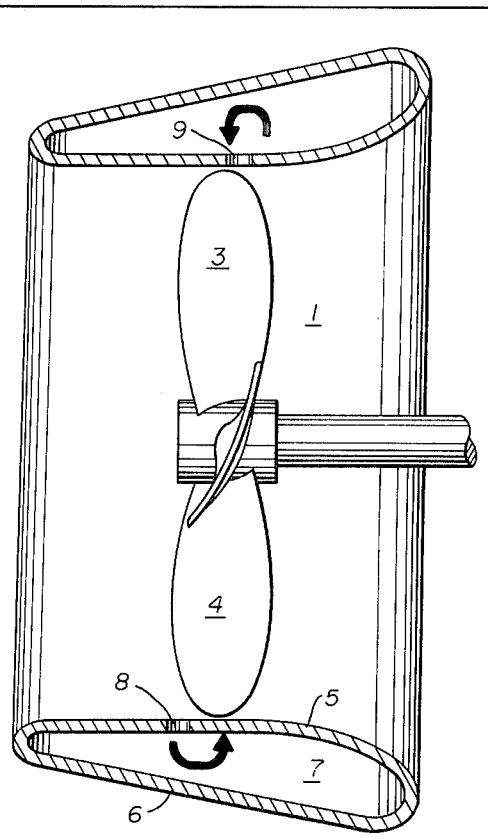
Figure 2A:
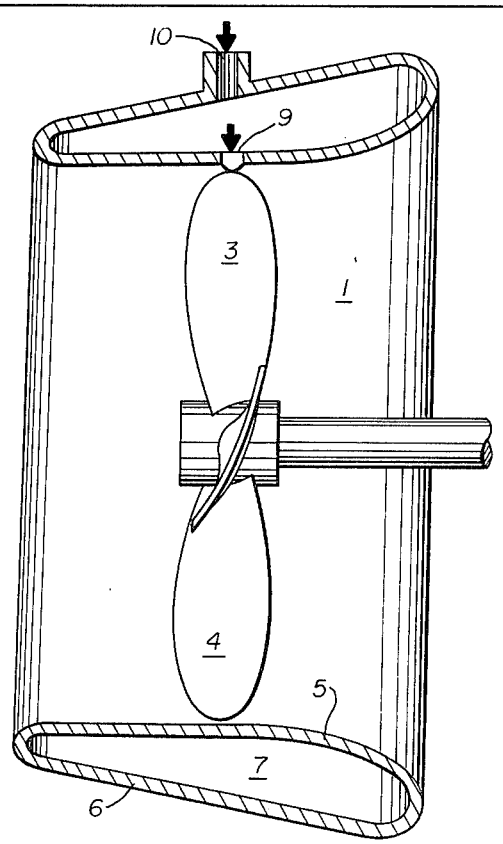
Figure 3:
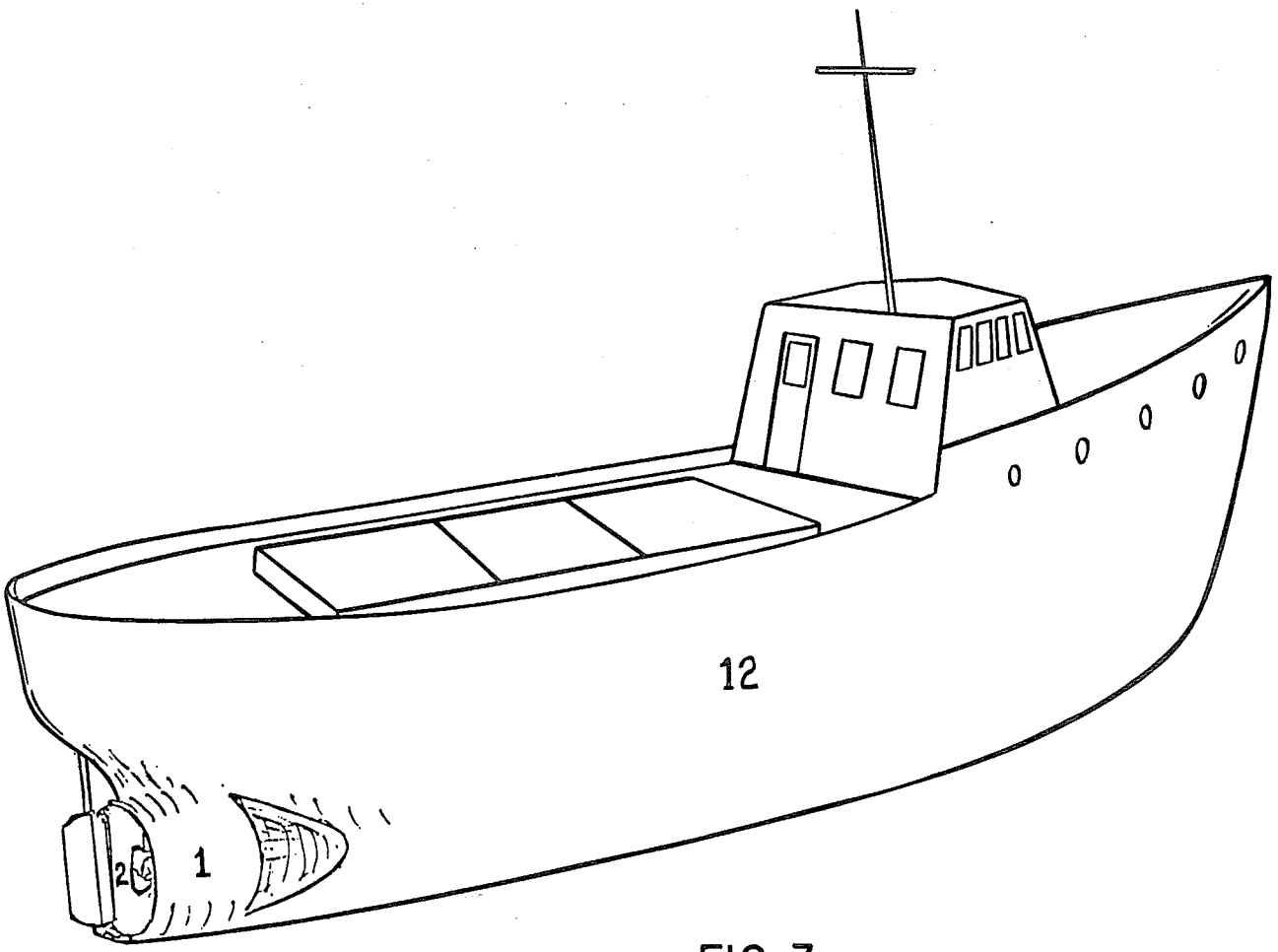
FIG. 3 shows a ship incorporating an embodiment of the present invention.

FIG. 2 shows an embodiment in which fluid is injected into the area adjacent to 9 by the assistance of flow inducing means external to the nozzle or duct communicating with annulus 7 by means of passage 10 for the purpose of suppressing cavitation.

Accordingly, a preferred embodiment of the invention provides for a nozzle or duct, a propeller rotatably mounted on the axis within the said nozzle or duct, passage means whereby fluid can be injected through the inner wall of said nozzle or duct at a location between the intersection of the vertical centerline with the circumference and the horizontal centerline coincident with the zone of cavitation within said nozzle or duct.

It is to be understood that the invention is applicable to both nozzles mounted externally to a ship's hull and to ducts forming an integral part within a ship's hull and embraces all manner of fabricating and component relation necessary to apply the invention to practice.

What is claimed is:

1. A marine propulsion system comprising a nozzle or duct, at least one propeller rotatably mounted on an axis within said nozzle or duct, walls forming a closed annular passage means within the nozzle or duct, means to pressurize water entrained in the annular passage means and a second passage means for introducing said pressurized water into a discrete area coincident with a zone of cavitation adjacent to the propeller within said nozzle or duct, for the purpose of suppressing cavitation, wherein said second passage means comprise a passage communicating between said annular passage means and an area above the horizontal centerline of said duct or nozzle coincident with a zone of potential cavitation within said nozzle or duct and positioned substantially in the plane of the propeller.

2. A marine propulsion system comprising a nozzle or duct, at least one propeller rotatably mounted on an axis within said nozzle or duct, walls forming a closed annular passage means within the nozzle or duct, a passage communicating between said annular passage and the space within said nozzle or duct below the horizontal centerline of same, and a passage communicating and adapted to direct pressurized water between said annular passage means and a discrete area above the said horizontal centerline coincidental with a zone of potential cavitation within said nozzle or duct and positioned substantially in the plane of the propeller.

3. A ship incorporating a propulsion system as claimed in claim 2.

* * * * *